US010651532B2

(12) United States Patent
Kim et al.

(10) Patent No.: US 10,651,532 B2
(45) Date of Patent: May 12, 2020

(54) VEHICLE ANTENNA MOUNTING APPARATUS

(71) Applicants: HYUNDAI MOTOR COMPANY, Seoul (KR); KIA MOTORS CORPORATION, Seoul (KR)

(72) Inventors: Eulyong Kim, Hwaseong-si (KR); Yong Ho Kim, Gunpo-si (KR); Byoung Hyun Lee, Yongin-si (KR); Dongjin Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 241 days.

(21) Appl. No.: 15/831,993

(22) Filed: Dec. 5, 2017

(65) Prior Publication Data

US 2018/0277922 A1 Sep. 27, 2018

(30) Foreign Application Priority Data

Mar. 24, 2017 (KR) ..... 10-2017-0037439

(51) Int. Cl.
*H01Q 1/12* (2006.01)
*H01Q 1/32* (2006.01)
*H01Q 1/42* (2006.01)

(52) U.S. Cl.
CPC ..... *H01Q 1/1214* (2013.01); *H01Q 1/3275* (2013.01); *H01Q 1/42* (2013.01)

(58) Field of Classification Search
CPC .... H01Q 1/1214; H01Q 1/325; H01Q 1/3275; H01Q 1/42
See application file for complete search history.

(56) References Cited

U.S. PATENT DOCUMENTS 6,554,555 B2 * 4/2003 Imahigashi ..... H01Q 1/1214 411/149
7,387,518 B2 * 6/2008 Kozlovski ..... F16B 5/0258 439/92

(Continued)

FOREIGN PATENT DOCUMENTS

JP 2006-248486 A 9/2006
KR 10-1154071 5/2012
KR 10-2015-0061872 6/2015

*Primary Examiner* — Daniel Munoz
*Assistant Examiner* — Patrick R Holecek
(74) *Attorney, Agent, or Firm* — Brinks Gilson & Lione

(57) ABSTRACT

A vehicle antenna mounting apparatus is disclosed, which includes: a base member mounted on an outer surface of a vehicle panel and covering an mounting hole formed in the outer surface; a screw shaft extending from a lower surface of the base member and passing through the mounting hole; and a fastening member having a support portion supported on the base member, and a plurality of elastic deformation portions extending from the support portion and provided with a locking portion at a lower end of the elastic deformation portions; a deformation guide member which is coupled to an outer surface of the screw shaft; and a tightening nut fastened to the screw shaft for moving and supporting the deformation guide member. The deformation guide member presses the elastic deformation portions in the radial direction of the screw shaft as the deformation guide member moves toward the base member.

13 Claims, 9 Drawing Sheets

(56) References Cited

U.S. PATENT DOCUMENTS

| | | | | |
|---|---|---|---|---|
| 8,511,634 | B2 * | 8/2013 | Lerchner ..... | H01Q 1/3275<br>248/534 |
| 9,966,707 | B2 * | 5/2018 | Hildebrand ..... | H01Q 1/1214 |
| 2009/0066593 | A1 | 3/2009 | Jared et al. | |
| 2011/0267243 | A1 | 11/2011 | Steinkamp et al. | |
| 2016/0104931 | A1 | 4/2016 | Chang | |

* cited by examiner

VEHICLE ANTENNA MOUNTING APPARATUS

CROSS-REFERENCE TO RELATED APPLICATION

This application claims priority to and the benefit of Korean Patent Application No. 10-2017-0037439, filed on Mar. 24, 2017, which is incorporated herein by reference in its entirety.

FIELD

The present disclosure relates to a vehicle antenna mounting apparatus.

BACKGROUND

The statements in this section merely provide background information related to the present disclosure and may not constitute prior art.

Recently, a roof antenna for receiving DMB (Digital Multimedia Broadcasting) broadcasting or the like has been installed on a roof panel of a vehicle.

A typical roof antenna is fixed by a fastening means such as a bolt or a nut, and a fastening portion of the roof antenna enters a mounting hole which is formed at the roof panel of the vehicle. Since the roof antenna is installed in a moving vehicle, it needs to be firmly connected to the roof panel. In addition, the watertightness of the mounting portion is desired to prevent the inflow of rainwater through the mounting hole of the roof panel.

It is not preferable that the fastening force of the fastening means is excessively large or small to mount the roof antenna on the roof panel. If the fastening force is too large, it may cause deformation of the roof panel, and if the fastening force is too small, the watertight performance of the mounting portion may be deteriorated.

SUMMARY

The present disclosure provides a vehicle antenna mounting apparatus capable of easily mounting an antenna and enabling stable installation of the antenna without deformation of a panel of the vehicle.

Another aspect of the present disclosure is to provide a vehicle roof antenna mounting apparatus capable of improving watertightness stability by uniformly applying a fastening force to a roof antenna mounting portion.

According to an aspect of the present disclosure, a vehicle antenna mounting apparatus may include: a base member mounted on an outer surface of a vehicle panel and configured to cover an mounting hole formed in the vehicle panel; a screw shaft extending from a lower surface of the base member and passing through the mounting hole; a fastening member having a support portion supported on the base member in a state of being coupled to the screw shaft, and a plurality of elastic deformation portions extending from the support portion and provided with a locking portion at a lower end of the plurality of the elastic deformation portions; a deformation guide member coupled to an outer surface of the screw shaft and configured to press the plurality of elastic deformation portions in a radial direction of the screw shaft as the deformation guide member moves toward the base member; and a tightening nut fastened to the screw shaft and configured to move and support the deformation guide member.

The base member may be mounted on a roof panel of the vehicle, the mounting hole is formed in the roof panel, and the screw shaft passing through the mounting hole enters an inside of the roof panel.

The locking portions of the plurality of the elastic deformation portions are caught on an inner surface of the roof panel.

The vehicle antenna mounting apparatus may further comprise: an outer sealing member coupled to a periphery of the base member and configured to seal a gap between the periphery of the base member and the outer surface of the vehicle panel; and an inner sealing member configured to seal a gap between the outer surface of the vehicle panel around the mounting hole and the lower surface of the base member.

The inner sealing member may be in the shape of a ring larger than the mounting hole, and both surfaces of the inner sealing member may be adhered to the lower surface of the base member and the outer surface of the vehicle panel.

The plurality of elastic deformation portions may comprise a first bending portion bent upwardly from a periphery of the support portion and then bent downwardly; and a second bending portion extending inwardly of the vehicle panel and then bent outwardly in an upward direction to form the locking portion.

The plurality of elastic deformation portions may be disposed at equal intervals around the screw shaft, and the respective locking portions may be disposed so as to maintain an equal distance from the screw shaft.

The base member may comprise a plurality of supporting holes formed at positions corresponding to the first bending portions so that the first bending portions of the plurality of elastic deformation portions enter and are supported.

The deformation guide member may comprise inclined pressing surfaces for pressing the second bending portions of the plurality of elastic deformation portions when the deformation guide member is moved toward the base member so that the locking portions are spread radially outward of the screw shaft.

The fastening member may be set such that a maximum distance between the locking portions is less than a width of the mounting hole in a state in which the fastening member is not fastened.

The vehicle antenna mounting apparatus further comprises a plurality of mounting guides protruding from the lower surface of the base member and configured to insert between the plurality of elastic deformation portions to enter the inside of the vehicle panel through the mounting hole and configured to maintain an equal distance from the screw shaft respectively, and the plurality of mounting guides can guide the screw shaft to be positioned at the center of the mounting hole when the base member is mounted.

The deformation guide member may comprise a plurality of guide grooves formed circumferentially in a periphery of the deformation guide member, the plurality of guide grooves are configured to be correspondingly engaged with the plurality of mounting guides.

The base member may comprise at least one wire passage hole through which a wire connected to an antenna module installed on an upper portion of the base member passes.

The vehicle antenna mounting apparatus may further comprise a provisional fastening member configured to provisionally fasten the base member to the mounting hole when the base member is mounted on the roof panel.

The provisional fastening member may comprise: a support plate installed on an upper surface of the base member; a plurality of extension portions extending from both ends of the support plate through the base member and the mounting hole to the inside of the vehicle panel and configured to be elastically deformed; and a locking portion provided at a lower end of each of the plurality of extension portions to be caught on the inner surface of the vehicle panel after entering the mounting hole.

The vehicle antenna mounting apparatus in one form of the present disclosure can be installed in a roof antenna in a state in which all the components of the mounting apparatus are assembled on the side of the roof antenna and a worker can complete the installation only by tightening the tightening nut at the inside of the roof panel or the vehicle panel, and therefore the roof antenna can be easily installed.

Further, the vehicle antenna mounting apparatus in one form of the present disclosure can reduce or prevent the deformation of the vehicle panel, such as the roof panel, because the excessive deformation can be alleviated by deforming the elastic deformation portions of the fastening member even if the tightening nut is excessively tightened in the installation process.

Further, the vehicle antenna mounting apparatus in the forms of the present disclosure can improve watertightness stability of the mounting portion since the centers of the fastening member, the deformation guide member and the screw shaft are precisely aligned with the center of the mounting hole by the guide of the plurality of mounting guides during the installation process, and thus the plurality of elastic deformation portions of the fastening member can be deformed uniformly so that the plurality of locking portions can press the inner surface of the roof panel with a uniform pressing force.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
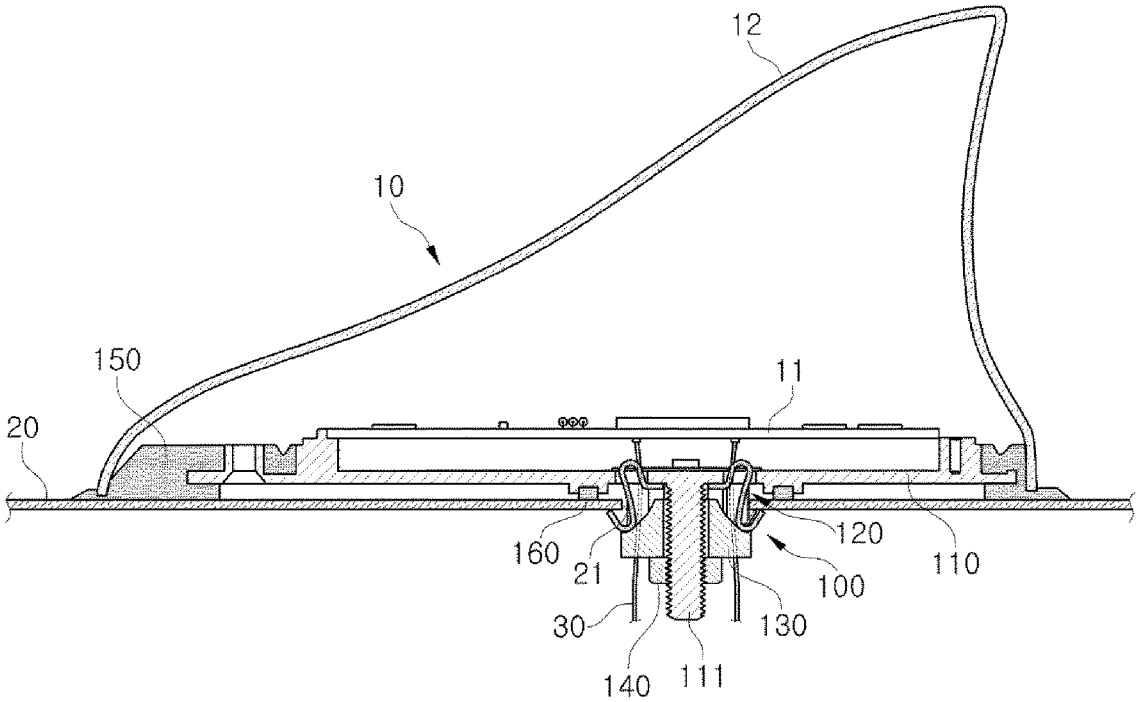
FIG. 1 shows a cross-sectional view a roof antenna as installed on a roof panel of a vehicle by a mounting apparatus.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features. The drawings are not intended to limit the scope of the present disclosure in any way, and the size of components may be exaggerated for clarity of illustration FIG. 1 shows a cross-sectional view a roof antenna as installed on a roof panel of a vehicle via a mounting apparatus in one form of the present disclosure, and FIG. 2 shows an exploded perspective view of a roof antenna to which the mounting apparatus in one form of the present disclosure is applied.

Figure 2:
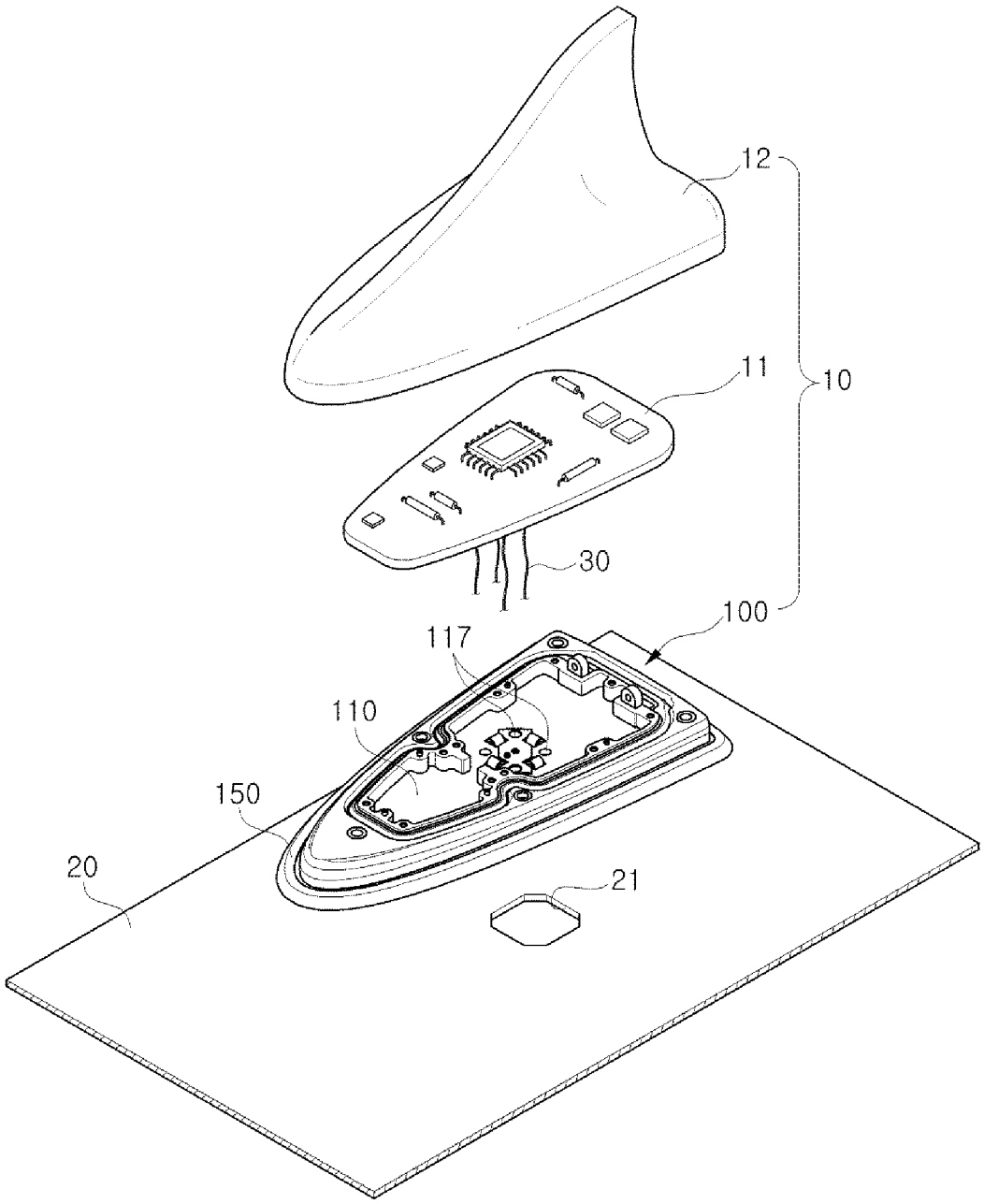
FIG. 2 shows an exploded perspective view of a roof antenna to which a mounting apparatus is applied.

Referring to FIGS. 1 and 2, a roof antenna 10 may include: a substrate-type antenna module 11 for receiving a radio signal, a mounting apparatus 100 installed on a roof panel 20 of a vehicle in a state in which the antenna module 11 is mounted on an upper portion thereof, and a streamlined cover member 12 covering the antenna module 11 and sealingly coupled to the mounting apparatus 100 at the lower periphery thereof.

The cover member 12, the antenna module 11 and the mounting apparatus 100 are assembled together, and the roof antenna 10 can be mounted on a vehicle using the mounting apparatus 100 in a state in which a mounting hole 21 is formed at the roof panel 20 of the vehicle.

Figure 3:
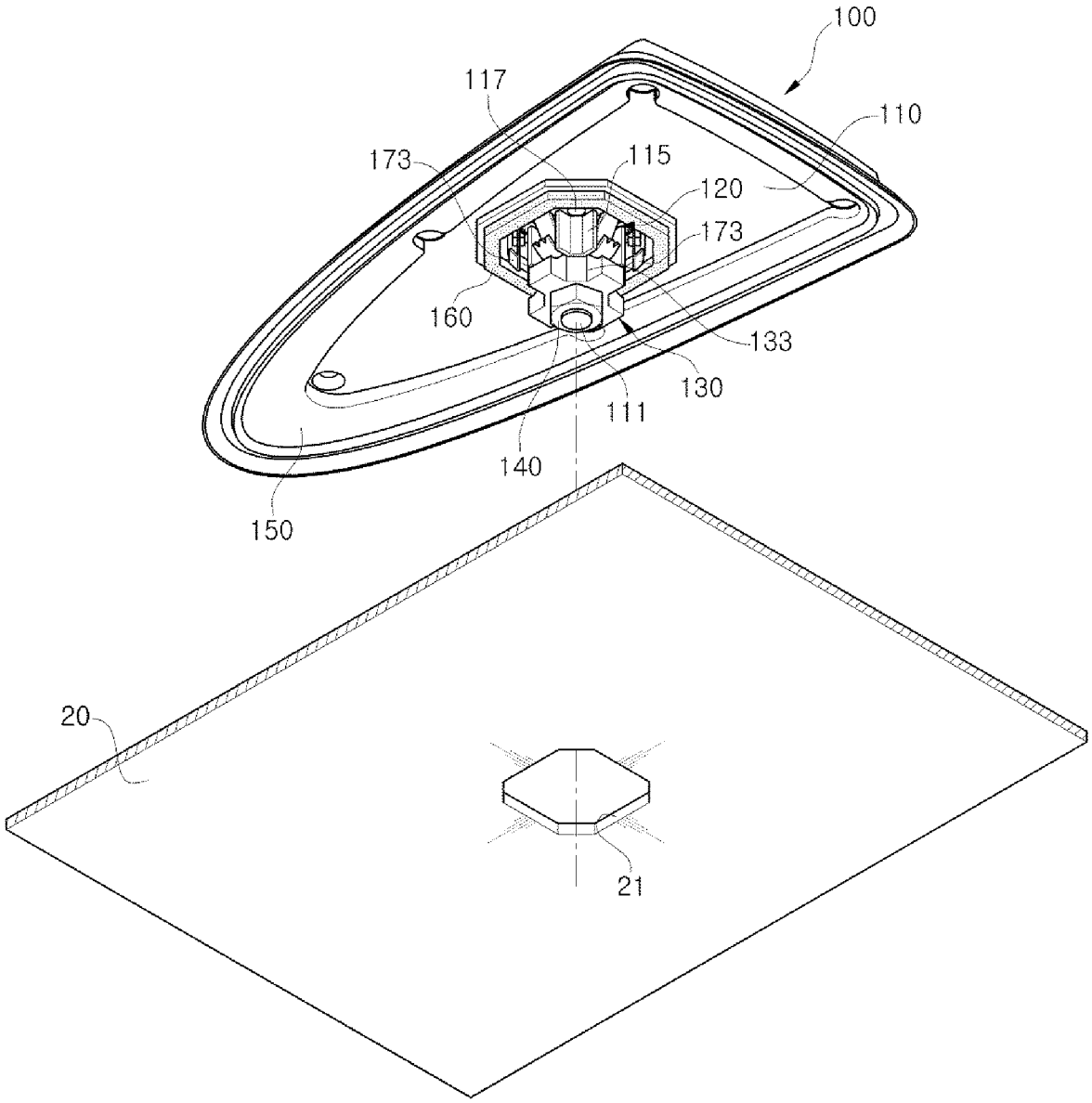
FIG. 3 shows a perspective view illustrating the assembled state of the roof antenna mounting apparatus viewed from a lower side.
Figure 4:
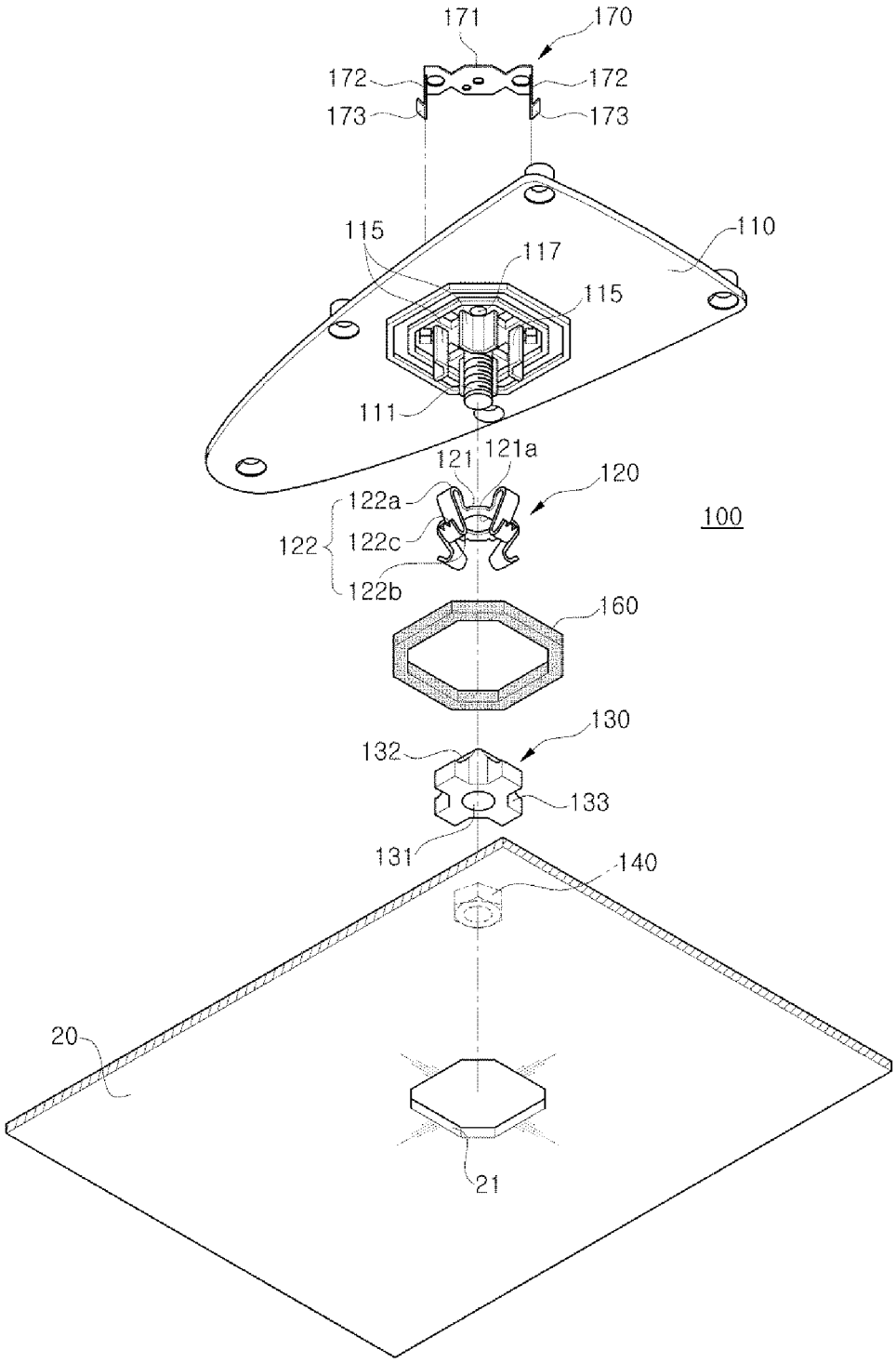
FIG. 4 shows an exploded perspective view of the roof antenna mounting apparatus and components of the mounting apparatus viewed from a lower side.
Figure 5:
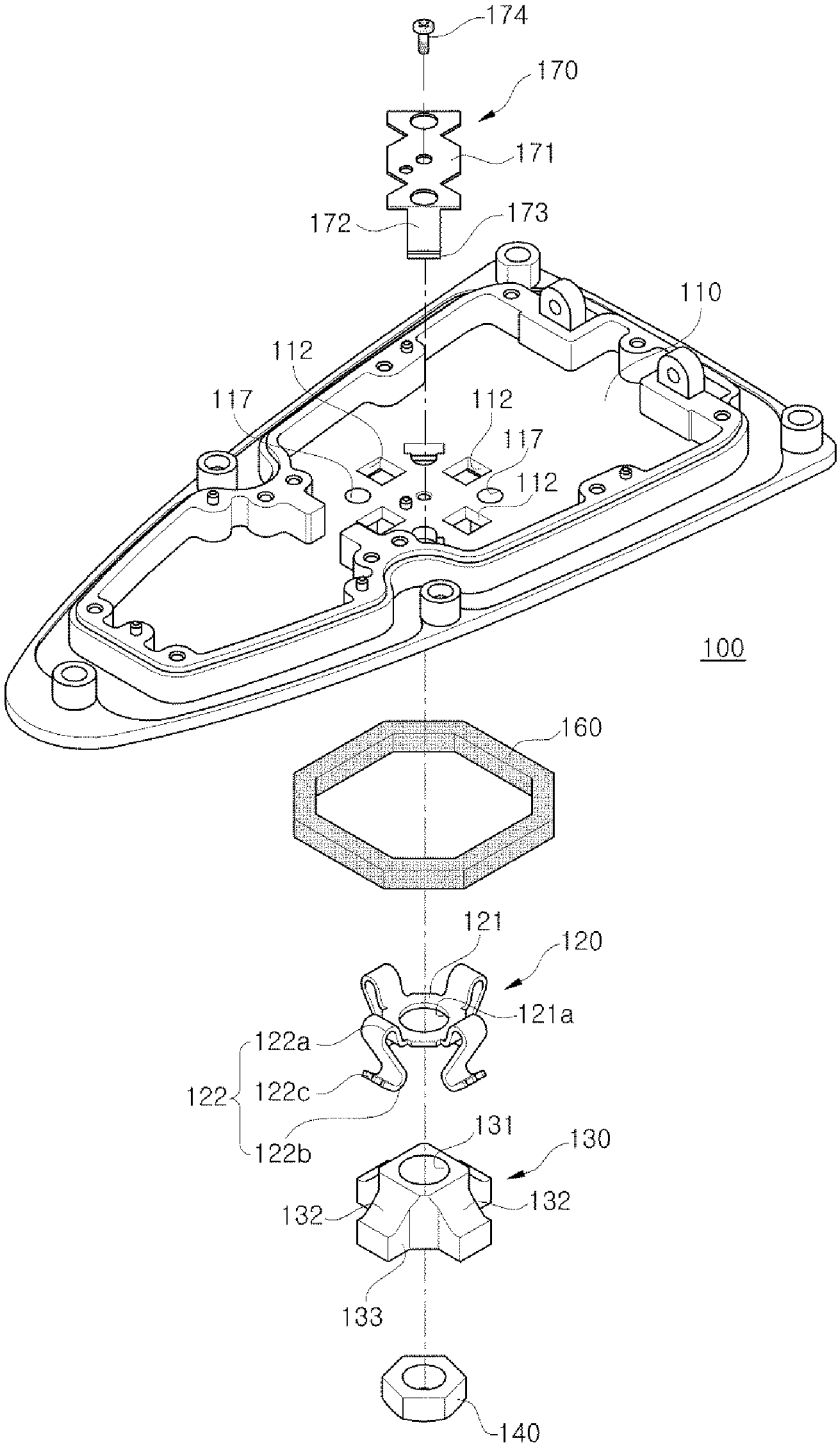
FIG. 5 shows an exploded perspective view of the roof antenna mounting apparatus and components of the mounting apparatus viewed from an upper side.
Figure 6:
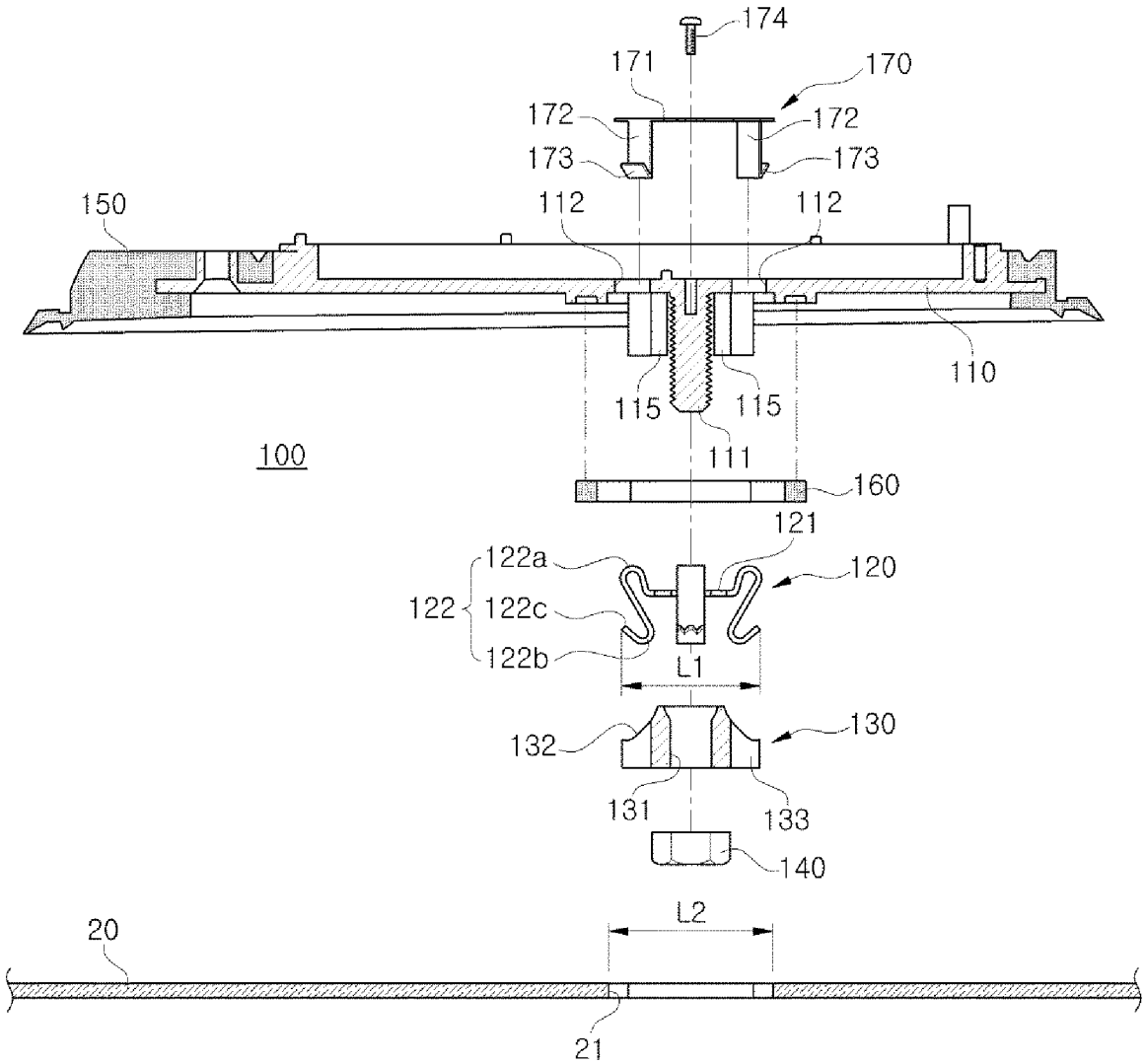
FIG. 6 shows an exploded cross-sectional view of the roof antenna mounting apparatus.

FIGS. 3 to 6 illustrate a roof antenna mounting apparatus in one form of the present disclosure. FIG. 3 illustrates a perspective view in the assembled state of the mounting apparatus wherein the mounting apparatus is viewed from the lower side, FIG. 4 illustrates an exploded perspective view of the mounting apparatus wherein components of the mounting apparatus are viewed from the lower side, FIG. 5 illustrates an exploded perspective view of the mounting apparatus wherein components of the mounting apparatus are viewed from the upper side, and FIG. 6 illustrates an exploded cross-sectional view of the mounting apparatus.

Referring to FIGS. 3 to 6, the roof antenna mounting apparatus 100 comprises a base member 110, a screw shaft 111, a fastening member 120, a deformation guide member 130, and a tightening nut 140.

The base member 110 is provided in the form of a streamlined panel and is installed outside the roof panel 20 so as to cover the mounting hole 21 of the roof panel 20. As shown in FIGS. 1 and 2, an outer sealing member 150 for sealing the gap between the base member 110 and the outer surface of the roof panel 20 is provided at the periphery of the base member 110, and an inner sealing member 160 for sealing the gap between the outer surface of the roof panel 20 around the mounting hole 21 and the lower surface of the base member 110 is provided at the lower surface of the base member 110.

The outer sealing member 150 may be formed of an elastic material such as rubber, silicon, or the like, and may be installed to partially surround the rim of the base member 110. The inner sealing member 160 may be provided in the shape of a polygonal ring slightly larger than the mounting hole 21 formed in the roof panel 20 by expanded polystyrene, and both surfaces of the inner sealing member may be adhered to the lower surface of the base member 110 and the outer surface of the roof panel 20. The inner sealing member 160 may be attached to the lower surface of the base member 110 as shown in FIG. 3 in a state before the roof antenna 10 is installed.

The periphery of the lower end of the cover member 12 installed on the base member 110 is sealed by the outer sealing member 150 installed at the periphery of the base member 110. Therefore, the antenna module 11 installed inside the cover member 12 can be protected from intrusion of rainwater or the like.

When the base member 110 is installed on the outer surface of the roof panel 20, as shown in FIG. 1, the gap between the periphery of the base member 110 and the roof panel 20 is firstly sealed by the outer sealing member 150, and the lower surface of the base member 110 around the mounting hole 21 and the outer surface of the roof panel 20 can be secondarily sealed by the inner sealing member 160. Therefore, after the roof antenna 10 is installed in the vehicle, external rainwater or the like can be inhibited or prevented from entering the space in which the mounting hole 21 or the antenna module 11 is accommodated.

The mounting hole 21 formed at the roof panel 20 may be a polygonal hole shape, as shown in FIGS. 3 and 4. Here, the polygonal mounting hole 21 is shown as an example, but the form of the mounting hole 21 is not limited thereto.

Figure 8:
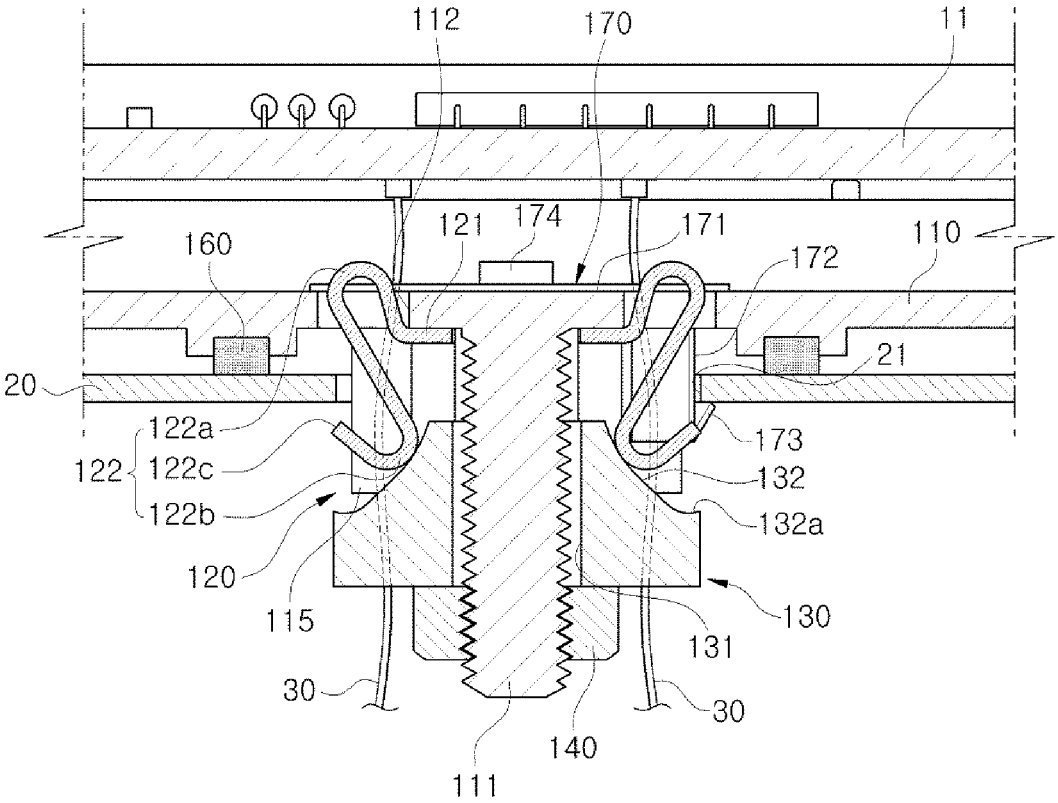

As shown in FIGS. 6 and 8, the screw shaft 111 extends downward from the lower surface of the base member 110 to a predetermined length so as to pass through the center of the mounting hole 21 of the roof panel 20 and enter the inside of the roof panel 20.

Figure 9:
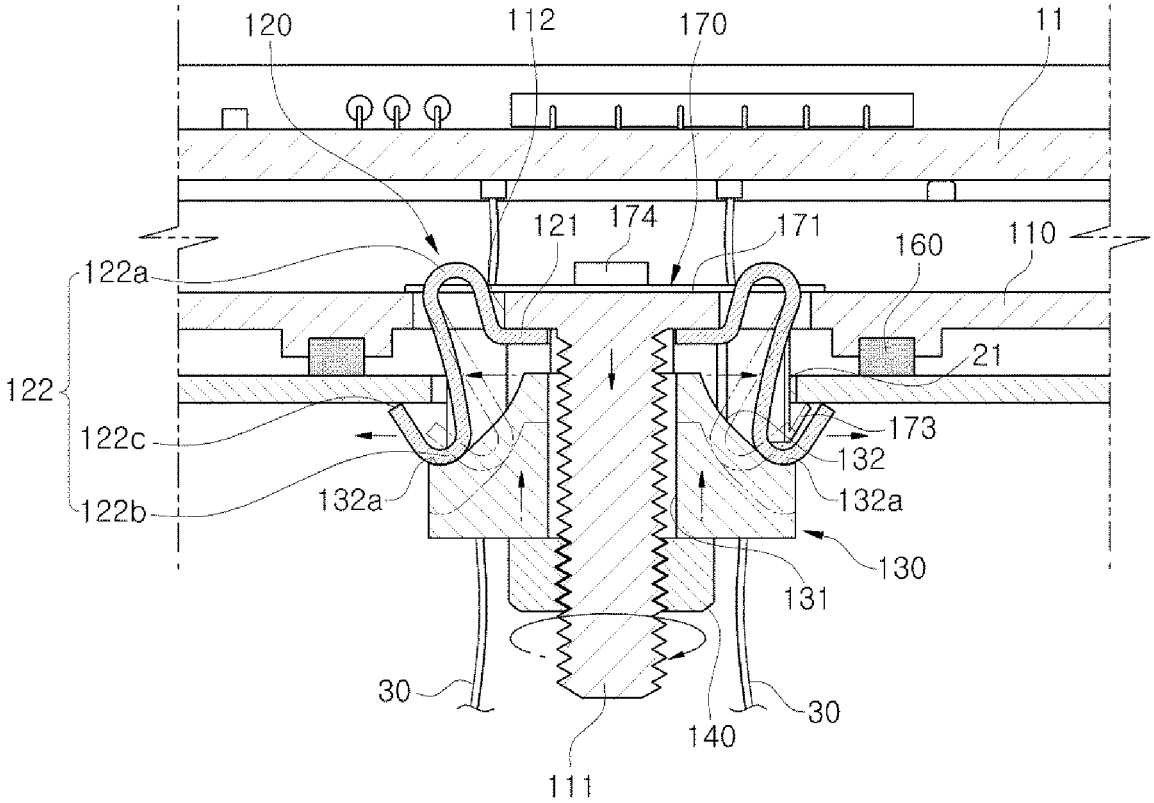

As shown in FIGS. 5, 6 and 9, the fastening member 120 comprises a support portion which has a through hole 121*a* that is coupled to the screw shaft 111 at the center thereof and is supported on the lower surface of the base member 110 in a state of being coupled to the screw shaft 111, and a plurality of elastic deformation portions 122 extending downward from the support portion 121 through the mounting hole 21 to enter the inside of the roof panel 20 and provided with a locking portion 122*c* at the respective lower ends thereof.

The plurality of elastic deformation portions 122 comprise a first bending portion 122*a* bent upwardly from a periphery of the support portion 121 and then bent downwardly, and a second bending portion 122*b* extending inwardly (downwardly) of the roof panel 20 from the first bending portion 122*a* and then bent outwardly in an upward direction to form the locking portion 122*c*. That is, each elastic deformation portion 122 is bent in an 'S' shape.

The plurality of elastic deformation portions 122 are arranged at equal intervals around the screw shaft 111 in such a manner that the respective locking portions 122*c* maintain a constant distance from the screw shaft 111. In the present form, four elastic deformation portions 122 are arranged around the screw shaft 111 at intervals of 90 degrees, but the number of the elastic deformation portions 122 can be changed.

As shown in FIG. 6, the fastening member 120 can be set such that the maximum distance L1 between the two locking portions 122*c* located on opposite sides of the fastening member 120 before the fastening member 120 is attached to the roof panel 20 is smaller than the width L2 of the mounting hole 21 formed at the roof panel 20. Therefore, as shown in FIGS. 7 and 8, the plurality of locking portions 122*c* can easily pass through the mounting hole 21 of the roof panel 20 and enter the inside of the roof panel 20 in the state where the fastening member 120 has been assembled to the screw shaft 111 and has not yet been fastened.

Figure 7:
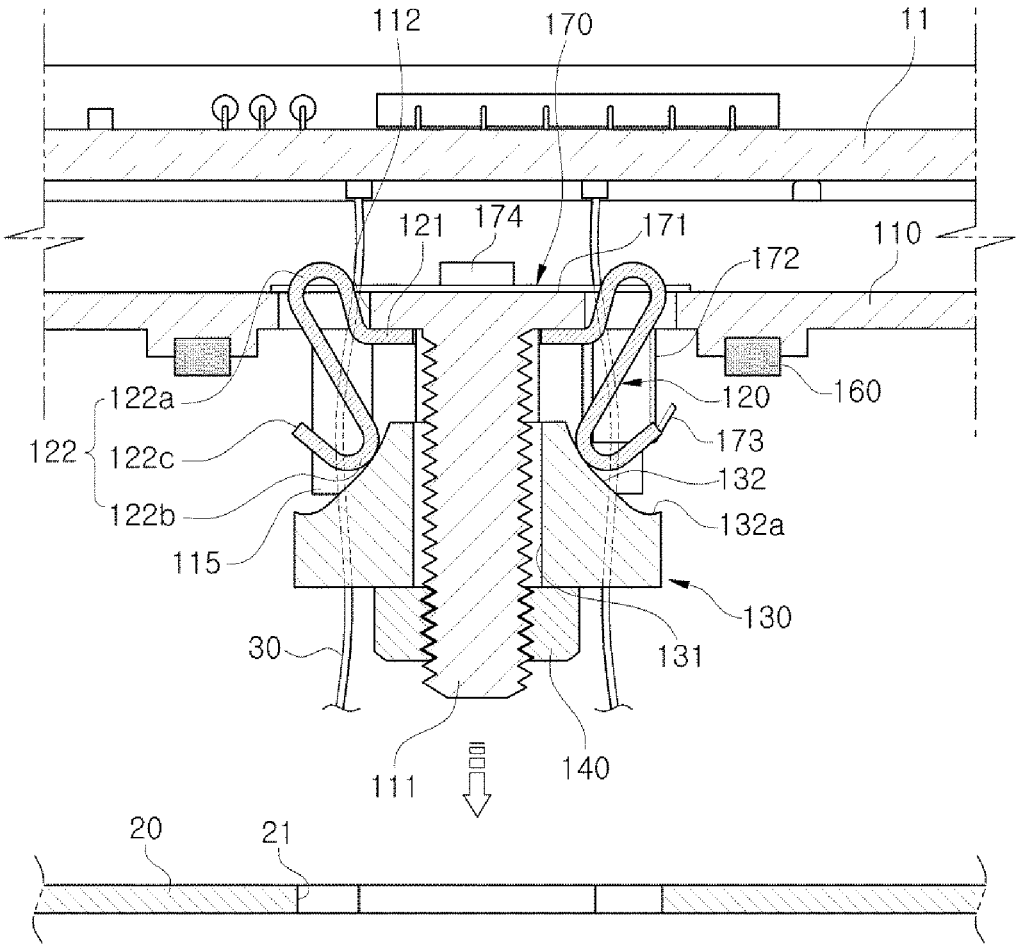
FIGS. 7 to 9 show cross-sectional views of a roof antenna mounting apparatus, which show the installation process step by step.

Referring to FIGS. 5 to 7, the base member 110 includes a plurality of supporting holes 112 formed at positions corresponding to the first bending portions 122*a* so that the first bending portions 122*a* of the plurality of elastic deformation portions 122 can enter and be supported in the state where the fastening member 120 is coupled to the screw shaft 111. Therefore, as shown in FIG. 7, the upper surface of the support portion 121 is supported by the lower surface of the base member 110 in a state where the support portion 121 is coupled to the screw shaft 111, and the plurality of first bending portions 122*a* enter the supporting holes 112 of the base member 110 respectively, to be restricted in rotation so that stable engagement can be maintained.

As shown in FIGS. 4 to 6, the deformation guide member 130 includes a through hole 131 formed at a central portion thereof so as to be coupled to the outer surface of the screw shaft 111, and conical inclined pressing surfaces 132 for pressing the second bending portions 122*b* of the plurality of elastic deformation portions 122 when moving toward the base member 110 in the state of being coupled to the screw shaft 111.

The deformation guide member 130 can move in the longitudinal direction of the screw shaft 111 by fitting the through hole 131 into the screw shaft 111, and thus the inclined pressing surfaces 132 simultaneously press the second bending portions 122*b* of the plurality of elastic deformation portions 122 as the deformation guide member 130 moves toward the base member 110 in a state where the deformation guide member 130 is engaged with the screw shaft 111 so that the respective locking portions 122*c* are spread radially outward of the screw shaft 111 and caught on the inner surface of the roof panel 20 as in the example shown in FIG. 9.

The tightening nut 140 is fastened to the screw shaft 111 after the fastening member 120 and the deformation guide member 130 are sequentially installed on the screw shaft 111. The tightening nut 140 can move the deformation guide member 130 toward the base member 110 by the tightening operation as in the example shown in FIG. 9, and as a result, each elastic deformation portion 122 of the fastening member 120 is deformed to be caught on the roof panel 20. Also, the tightening nut 140 can hold the fastening state by the fastening member 120 by maintaining the tightening state and supporting the deformation guide member 130.

Referring to FIGS. 3, 4 and 6, the roof antenna mounting apparatus 100 may comprises a plurality of mounting guides 115 provided on the base member 110 for guiding the installation, and a provisional fastening member 170 for provisionally fastening the base member 110 to the mounting hole 21 when the base member 110 is mounted on the roof panel 20.

The plurality of mounting guides 115, as shown in FIG. 8, protrude from the lower surface of the base member 110 and insert between the plurality of elastic deformation portions 122 so as to enter the inside of the roof panel 20 through the mounting holes 21. Each of the plurality of mounting guides 115 is spaced apart from the screw shaft 111 by an equal distance and extends parallel to the screw shaft 111 from the lower surface of the base member 110 downward.

The plurality of mounting guides 115 are respectively kept in contact with the mounting hole 21 when the base member 110 is installed so that the screw shaft 111 is positioned at the center of the mounting hole 21. When the screw shaft 111 is positioned at the center of the mounting hole 21, the center of the fastening member 120 and the deformation guide member 130 coupled to the screw shaft 111 are accurately positioned with respect to the center of the mounting hole 21. Therefore, as shown in FIG. 9, the plurality of elastic deformation portions 122 can be uniformly deformed in the final fastening process, and each locking portion 122*c* can be caught on the inner surface of the roof panel 20 while maintaining a uniform pressing force.

The deformation guide member 130, as shown in FIGS. 4 and 5, includes a plurality of guide grooves 133 formed at the periphery thereof so as to be coupled with the plurality of mounting guides 115 in a corresponding manner. Therefore, since the movement of the deformation guide member 130 is guided by the plurality of mounting guides 115 coupled with the plurality of guide grooves 133, the rotation of the deformation guide member 130 is restricted when the deformation guide member 130 moves along the screw shaft 111. As a result, when the plurality of elastic deformation portions 122 are pressed, distortion of the elastic deformation portions 122 can be substantially reduced or prevented, thereby uniformly deforming the plurality of elastic deformation portions 122 so that a uniform fastening force can be applied to the respective locking portions 122*c*. In addition, since the rotation of the deformation guide member 130 is restricted after the fastening, stable fastening can be maintained.

The provisional fastening member 170, as shown in FIGS. 5, 6 and 8, comprise a support plate installed on an upper surface of the base member 110, a plurality of extension portions 172 extending from both ends of the support plate 171 through the base member 110 and the mounting hole 21 to the inside of the roof panel 20 and elastically deformed, and a locking portion 173 being bent outward from a lower end of the respective extension portions 172 to be caught on the inner surface of the roof panel 20 after entering the mounting hole 21. The support plate 171 is fixed to the upper surface of the base member 110 by fastening a fixing screw 174 to the center thereof.

As shown in FIGS. 7 and 8, the provisional fastening of the mounting apparatus 100 is achieved by the locking portion 173 provided at the lower end of the respective extension portions 172 of the provisional fastening member 170 entering into the mounting hole 21 together and being caught on the inner surface of the roof panel 20 when the deformation guide member 130 and the fastening member 120 enter the mounting hole 21 of the roof panel 20 in the initial installation process. That is, as in the example shown in FIG. 8, the provisional fastening is performed in a state in which the tightening nut 140 is not tightened and the respective elastic deformation portions 122 of the fastening member 120 are not deformed.

Referring to FIGS. 4, 5 and 8, the base member 20 may have at least one wire through hole 117 through which the wire 30 connected to the antenna module 11 installed on the base member 20 passes. In the present form, four wire through holes 117 are formed in the base member 110 so that the plurality of electric wires 30 connected to the antenna module 11 are allowed to pass through the base member 110 and the mounting hole 21 and enter the inside of the roof panel 20 in a state where the installation of the roof antenna 10 is completed.

The wire through holes 117 may be provided at positions close to the plurality of mounting guides 115, respectively. This provides that wires 30 passing through the wire through holes 117 are smoothly entered into the roof panel 20 through the side space of the mounting guides 115 and the guide grooves 133 of the deformation guide member 130. The plurality of mounting guides 115 may have a cross-sectional structure of 'L' shape in order to secure the entry space of the wires 30.

A method of installing the roof antenna mounting apparatus 100 in one form of the present form will be described below with reference to FIGS. 7 to 9.

FIGS. 7 to 9 are cross-sectional views of the roof antenna mounting apparatus, which show the installation process step by step.

The roof antenna mounting apparatus 100, as shown in FIG. 7, is in a state in which all the components are assembled to the roof antenna 10 before the roof antenna 10 is installed on the roof panel 20 of a vehicle. That is, the fastening member 120, the deformation guide member 130, and the tightening nut 140 are provisionally fastened to the screw shaft 111 provided at the lower side of the base member 110.

When the roof antenna 10 is installed in the state of FIG. 7, as shown in FIG. 8, the tightening nut 140, the deformation guide member 130 and the locking portion 122*c* of the fastening member 120 assembled on the lower side of the base member 110 are inserted into the mounting hole 21 of the roof panel 20. At this time, because the maximum width of the deformation guide member 130 is smaller than the minimum width of the mounting hole 21 and the maximum distance between the locking portions 122*c* on the lower side of the fastening member 120 is also smaller than the minimum width of the mounting hole 21, the deformation guide member 130 and the lower side of the fastening member 120 can easily enter the inside of the roof panel 20 through the mounting hole 21.

When the mounting apparatus 100 is installed as in the state of FIG. 8, the locking member 173 of the provisional fastening member 170 enters the mounting hole 21 and is hooked on the inner surface of the roof panel 20. Thus, provisional fastening of the mounting apparatus 100 is performed. In addition, the inner sealing member 160 disposed to the lower surface of the base member 110 is attached to the outer surface of the roof panel 20 and the outer sealing member 150 disposed at the periphery of the base member 110 is also in close contact with the outer surface of the roof panel 2. The wires 30 connected to the antenna module 11 can also enter the inside of the mounting hole 21 in the state of FIG. 8.

In order to fasten the fastening member 120 completely from the state of FIG. 8, the tightening nut 140 fastened to the screw shaft 111 is tightened inside the roof panel 20 as shown in FIG. 9. In this way, a firm fastening is achieved by the deformation guide member 130 being lifted and the plurality of elastic deformation portions 122 of the fastening member 120 being spread outward by the upward movement of the deformation guide member 130 to be caught on the inner surface of the roof panel 20.

As described above, because the mounting apparatus 100 in one form of the present form can install the roof antenna 10 in a state where all the components of the mounting apparatus are assembled on the side of the roof antenna 10 and the installation can be completed only by a worker tightening the tightening nut 140 inside the roof panel 20, the roof antenna 10 can be easily mounted on the vehicle. That is, since fastening can be completed without mounting a separate component inside the roof panel 20, easy installation is possible.

The mounting apparatus 100 can substantially reduce or prevent the roof panel 20 from being deformed because even if the tightening nut 140 is excessively tightened in the installation process, the elastic deformation portions 122 of the fastening member 120 is deformed to alleviate the excessive tightening. Further, as shown in FIG. 9, the excessive tightening of the tightening nut 140 can be inhibited or prevented because when the deformation guide member 130 is lifted and the second bending portion 122*b* of each elastic deformation portion 122 reaches a locking surface 132*a* of the lower end of each of the inclined guide surfaces 132 in the final installation process, tightening can be limited.

The vehicle roof antenna mounting apparatus 100 in one form of the present form can improve watertightness stability of the mounting portion since the centers of the fastening member 120, the deformation guide member 130 and the screw shaft 111 are precisely aligned with the center of the mounting hole 21 by the guide of the plurality of mounting guides 115 during the installation process, and thus the plurality of elastic deformation portions 122 of the fastening member 120 can be deformed uniformly so that the plurality of locking portions 122*c* can press the inner surface of the roof panel 20 with a uniform pressing force.

What is claimed is:

1. A vehicle antenna mounting apparatus, comprising:

a base member mounted on an outer surface of a vehicle panel and configured to cover a mounting hole formed in the vehicle panel;

a screw shaft extending from a lower surface of the base member and passing through the mounting hole;

a fastening member having a support portion supported on the base member in a state of being coupled to the screw shaft, and a plurality of elastic deformation portions extending from the support portion and provided with a locking portion at a lower end of the plurality of the elastic deformation portions;

a deformation guide member coupled to an outer surface of the screw shaft and configured to press the plurality of elastic deformation portions in a radial direction of the screw shaft as the deformation guide member moves toward the base member; and a tightening nut fastened to the screw shaft and configured to move and support the deformation guide member, wherein the plurality of elastic deformation portions comprise:

a first bending portion bent upwardly from a periphery of the support portion and then bent downwardly; and a second bending portion extending inwardly of the vehicle panel and then bent outwardly in an upward direction to form the locking portion, and wherein the fastening member is set such that a maximum distance between the locking portions is less than a width of the mounting hole in a state in which the fastening member is not fastened.

2. The vehicle antenna mounting apparatus according to claim 1, wherein the base member is mounted on a roof panel of the vehicle and the mounting hole is formed in the roof panel, wherein the screw shaft passing through the mounting hole enters an inside of the roof panel.

3. The vehicle antenna mounting apparatus according to claim 2, wherein the locking portions of the plurality of the elastic deformation portions are caught on an inner surface of the roof panel.

4. The vehicle antenna mounting apparatus according to claim further comprising:

an outer sealing member coupled to a periphery of the base member and configured to seal a gap between the periphery of the base member and the outer surface of the vehicle panel; and an inner sealing member configured to seal a gap between the outer surface of the vehicle panel around the mounting hole and the lower surface of the base member.

5. The vehicle antenna mounting apparatus according to claim 4, wherein the inner sealing member is in the shape of a ring larger than the mounting hole, and both surfaces of the inner sealing member are adhered to the lower surface of the base member and the outer surface of the vehicle panel.

6. The vehicle antenna mounting apparatus according to claim 1, wherein the plurality of elastic deformation portions are disposed at equal intervals around the screw shaft, and the respective locking portions are disposed so as to maintain an equal distance from the screw shaft.

7. The vehicle antenna mounting apparatus according to claim 6, wherein the base member comprises a plurality of supporting holes formed at positions corresponding to the first bending portions so that the first bending portions of the plurality of elastic deformation portions enter and are supported.

8. The vehicle antenna mounting apparatus according to claim 1, wherein the deformation guide member comprises inclined pressing surfaces configured to press the second bending portions of the plurality of elastic deformation portions when the deformation guide member is moved toward the base member so that the locking portions are spread radially outward of the screw shaft.

9. The vehicle antenna mounting apparatus according to claim 1, further comprising: a plurality of mounting guides protruding from the base member and configured to insert between the plurality of elastic deformation portions to enter the inside of the vehicle panel through the mounting hole and configured to maintain an equal distance from the screw shaft respectively, wherein the plurality of mounting guides guide the screw shaft to be positioned at the center of the mounting hole when the base member is mounted.

10. The vehicle antenna mounting apparatus according to claim 9, wherein the deformation guide member comprises a plurality of guide grooves formed circumferentially in a periphery of the deformation guide member, the plurality of guide grooves are configured to be correspondingly engaged with the plurality of mounting guides.

11. The vehicle antenna mounting apparatus according to claim 1, wherein the base member comprises at least one wire passage hole through which a wire connected to an antenna module installed on an upper portion of the base member passes.

12. The vehicle antenna mounting apparatus according to claim 1, further comprising: a provisional fastening member configured to provisionally fasten the base member to the mounting hole when the base member is mounted on the vehicle panel.

13. The vehicle antenna mounting apparatus according to claim 12, wherein the provisional fastening member comprise: a support plate installed on an upper surface of the base member; a plurality of extension portions extending from both ends of the support plate through the base member and the mounting hole to the inside of the vehicle panel and configured to be elastically deformed; and a locking portion provided at a lower end of each of the plurality of extension portions to be caught on the inner surface of the vehicle panel after entering the mounting hole.

* * * * *